United States Patent [19]

Gieseker

[11] Patent Number: 4,974,848

[45] Date of Patent: Dec. 4, 1990

[54] MAZE DEVICE

[76] Inventor: Gerald A. Gieseker, 6277 Estes St., Apt. 2, Arvada, Colo. 80004

[21] Appl. No.: 326,089

[22] Filed: Mar. 20, 1989

[51] Int. Cl.[5] ..... A63F 9/08

[52] U.S. Cl. ..... 273/153 R

[58] Field of Search ..... 273/153 R, 156; 70/290

[56] References Cited

U.S. PATENT DOCUMENTS

| | | | |
|---|---|---|---|
| 2,591,303 | 4/1952 | Schriner et al. | 273/156 |
| 2,714,511 | 8/1955 | Derrig | 273/153 R |
| 3,594,005 | 7/1971 | Vennola et al. | 273/153 R |
| 3,637,215 | 1/1972 | Keister | 273/155 |
| 3,819,187 | 6/1974 | Downs | 273/156 |
| 3,824,815 | 7/1974 | Darling | 70/18 |
| 3,847,398 | 11/1974 | Kidd | 273/156 |
| 4,065,132 | 12/1977 | Giakas | 273/153 R |
| 4,357,016 | 11/1982 | Allison | 273/156 |

*Primary Examiner*—Edward M. Coven
*Assistant Examiner*—Raleigh W. Chiu
*Attorney, Agent, or Firm*—John E. Reilly

[57] ABSTRACT

A labyrinth or maze has an elongated cylindrical member with a central bore, a shaft disposed in the bore including a transversely radial arm, the shaft being movable in the bore and can be manually grasped for combined rotational and axially slidable movement through a continuous but winding passageway defining an internal maze in communication with the bore along its length. Preferably, the cylindrical member is defined by a plurality of annular disks in which individual circumferential slots are formed in each disk and are aligned to be in communication with one another throughout the length of the member to form the internal maze for puzzles, games, video games, and other amusement devices; also, it can be readily used as a locking device by placement of a locking element in the path of the arm so that engagement by the arm will cause the locking member to be advanced to an unlocked position with respect to another fixed member, such as, the wall of a safe.

17 Claims, 5 Drawing Sheets

MAZE DEVICE

This invention relates to maze devices; and more particularly relates to a novel and improved maze construction which is adaptable for use as a puzzle, game or locking device with the ability to be easily constructed in varying degrees of complexity according to the skill level or sophistication of the user and of the intended application of the device.

BACKGROUND AND FIELD OF INVENTION

Numerous approaches have been taken to the construction and design of mazes for various purposes, most notable of which are puzzles or games in which the player must by sight or by feel locate a series of winding passages, commonly referred to as a labyrinth or maze, and advance an object through the passages to reach the end and solve the puzzle. For example, U.S. Letters Pat. No. 2,591,303 to R. M. Schriner et al discloses a puzzle in which a series of rotatable collars are mounted on a common shaft, and the shaft is removable only by rotating the collars to align pins with notches on the collars.

U.S. Letters Pat. No. 2,714,511 to D. J. Derrig also discloses a combination of a shaft having a dog which must be advanced through spaced annular ribs, the ribs having transverse slots through which the dog must pass. Several different versions are disclosed in Derrig but in any case requires an outer canister or container for the ribs; also, for a given number of ribs or rings requires open spaces between radial slots and is limited in the number of combinations of guideways through the maze which may be devised. A similar approach to that of Derrig is disclosed in U.S. Letters Pat. No. 4,065,132 to W. Giakas.

Maze-type constructions have been proposed in the past for use in locking devices and, for example, reference is made to U.S. Letters Pat. Nos. 3,824,815 to W. A. Darling and 3,847,398 to D. A. Kidd. Both patents to Darling and Kidd employ a pawl element and are unidirectional in the axial dimension as well as having moving parts on the plunger or shaft and spacing between the ring or disk elements to permit rotation. Other patents of interest in connection with maze-type puzzles, games and the like are U.S. Letters Pat. Nos. 3,637,215 to W. Keister, 3,819,187 to G. W. Downs, 3,594,005 to J. Vennola and 4,357,016 to M. H. Allison. Of the prior art patents of interest that employ a cylindrical maze, the maze or labyrinth is typically located between a pair of cylindrical members or at some radial distance away from the movable shaft or axis but does not radiate away from the shaft or axis so as to be internally generated.

The problems which the present invention is aimed to overcome is the construction of a compact internally generated maze which employs a minimum number of moving parts, is simplified and durable in construction, can be designed in varying degrees of complexity and is readily conformable for use in various other applications including but not limited to locking devices, amusement parks and video games.

SUMMARY OF THE INVENTION

Accordingly, it is an object of the present invention to provide for a novel and improved maze device which is comprised of a minimum number of parts and is easy to fabricate and assemble into a compact unit.

It is a further object of the present invention to provide for a novel and improved maze puzzle or game which is rugged and durable in construction, lightweight and compact with but a single moving part or element which can be manipulated by the player in advancing through a labyrinth or pathway formed in the maze and requires extreme skill and dexterity on the part of the player.

Yet another objective of the present invention is to provide for novel and improved locking device employing an internal maze-type construction which is substantially tamperproof and rugged construction.

It is an additional object of the present invention to provide for a novel and improved maze device of the axial labyrinth type which employs a plurality of coded, disk-shaped elements rigidly interconnected to define a concealed pathway through a maze; and further wherein the device is readily conformable for use in puzzles, games, locking devices and can range in size from a simple hand-held device to a building size structure.

In accordance with the present invention, a labyrinth device comprises an elongated member provided with a longitudinally extending bore extending therethrough, a shaft disposed in the bore including a transversely extending arm, the shaft being freely rotatable and axially movable in the bore and having a trailing end projecting from the elongated member to be manually grasped for combined rotational and axially slidable movement of the shaft and arm with respect to the bore, and the elongated member includes a continuous but winding passageway defining an internal maze in communication with the bore along its length, the passageway varying in rotational orientation at predetermined intervals along the length of the bore and further being of a length to receive the transversely extending arm so that the arm can advance through the passageway by combined rotational and axial movement. Preferably, the elongated member is generally cylindrical and is provided with a central bore, the internal maze formed of a series of circumferential slots extending radially and outwardly from the bore. Further, the elongated member can be defined by a plurality of annular disks in which individual circumferential slots are formed in each disk and are aligned to be in communication with one another throughout the length of the member to form the internal maze. The labyrinth devices as described lend themselves particularly well to use in puzzles or games; also, they can be readily used as locking devices by placement of a locking element in the path of the transversely extending arm so that engagement by the arm will cause the locking member to be advanced to an unlocked position with respect to another fixed member, such as, the wall of a safe.

Other objects, advantages and features of the present invention will become more readily appreciated and understood when taken together with the following detailed description in conjunction with the accompanying drawings, in which:

DETAILED DESCRIPTION OF ONE PREFERRED EMBODIMENT

Figure 1:
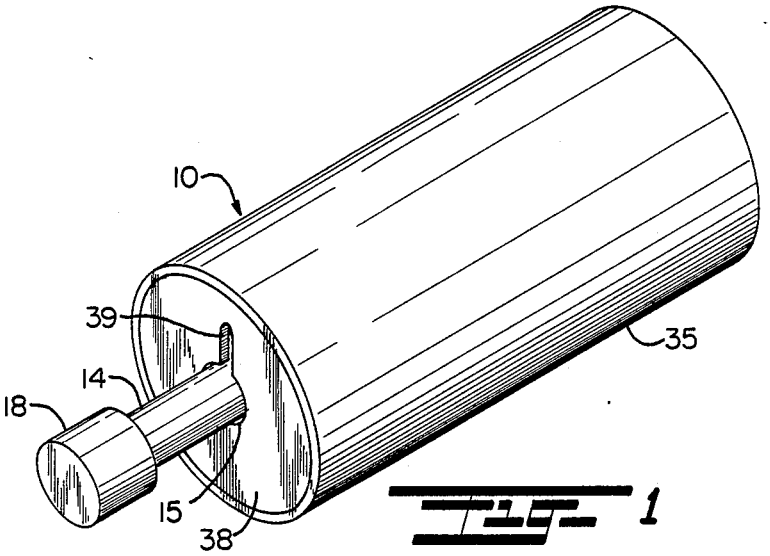
FIG. 1 is a perspective view of one preferred form of maze in accordance with the present invention to be employed as a puzzle or game.

Referring in more detail to the drawings, there is illustrated in FIGS. 1 to 7 a puzzle 10 which is broadly comprised of a generally cylindrical maze 12 and a shaft 14 insertable through a central opening or bore 15 in the maze 12, the shaft having a transverse or radially extending arm or dog 16 at one end thereof and a handle 18 at the opposite end.

Figure 2:
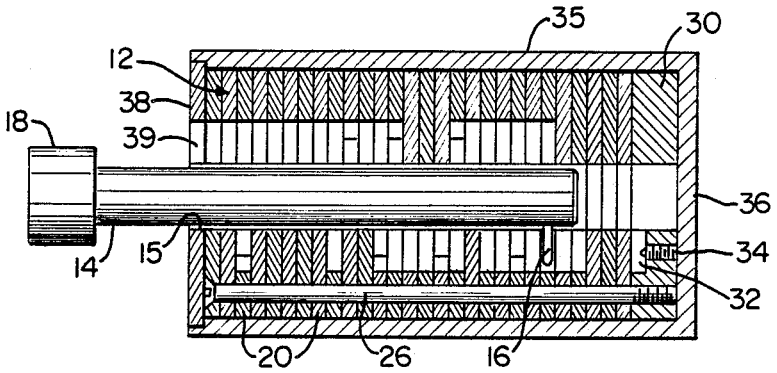
FIG. 2 is a view partially in section of the maze illustrated in FIG. 1.
Figure 4:
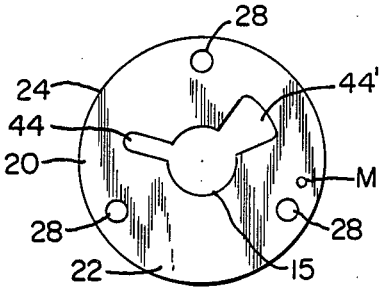
FIGS. 4, 5, 6 and 7 are elevational views of individual disks elements employed in the form of invention illustrated in FIGS. 1 to 3.
Figure 5:
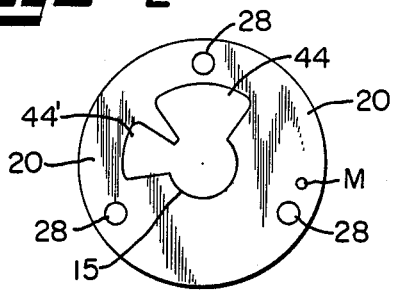
Figure 6:
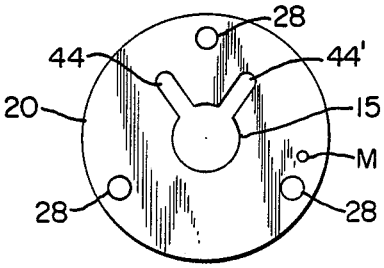
Figure 7:
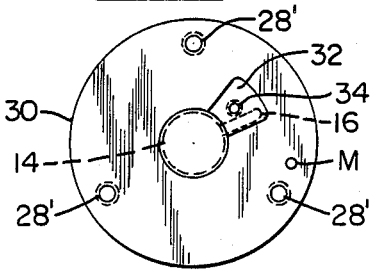
Figure 3:
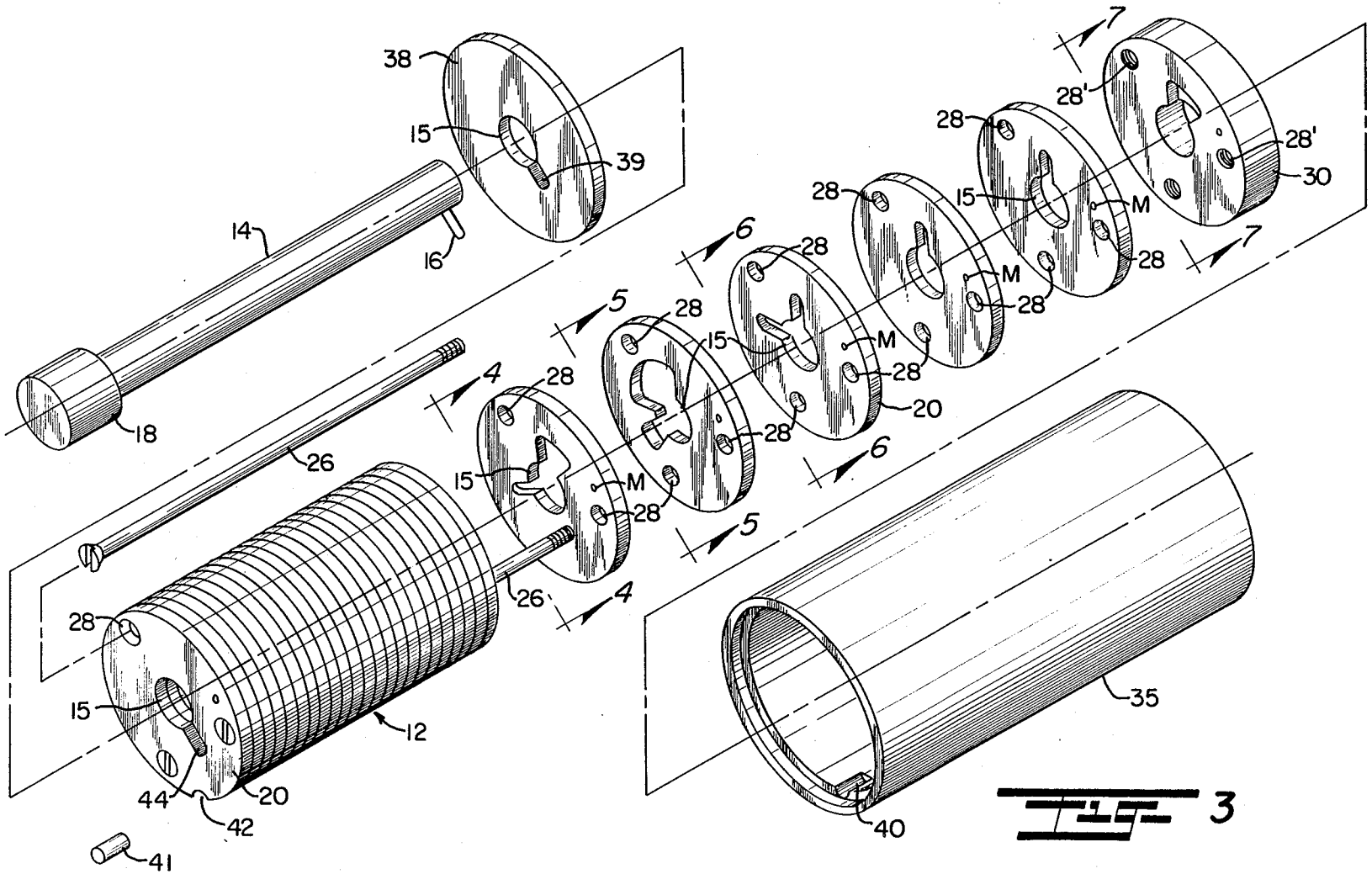
FIG. 3 is an exploded view of the form of invention illustrated in FIGS. 1 and 2.

As seen from FIGS. 2 and 3, the maze 12 consists of a plurality of circular, disk-like elements 20, each disk having opposed flat surfaces, such as, the surface 22 illustrated in FIG. 4, and an outer peripheral edge 24. Preferably, the elements 20 are of corresponding thickness and size or diameter and are connected together in face-to-face relation by means of lag bolts 26 which extend through the bores 28 in each disk. A thicker disk element 30 is positioned at one end of the maze and is provided with threaded bores 28' so that each bolt 26 passes freely through one of the bores 28 in each of the disks 20 and is then threaded into the bore 28' of the end disk 30. The end disk 30 is illustrated in detail in FIG. 7 and includes a radially extending or pie-shaped slot 32 with a ball plunger 34 extending through a threaded bore in the disk to project slightly into the slot 32, as illustrated in FIG. 2.

The maze 12 as described is preferably housed within a canister or container 35 which is of hollow cylindrical configuration and has a closed end 36. The front or entrance end of the maze is covered by an end plate 38 which may be suitably bonded or welded into the end of the container opposite to the end plate 36 and is provided with a narrow, radially extending slot 39. In order to prevent rotation of the maze assembly within the container, notched elements 42 on the peripheral edges 24 of the disk must be aligned with the groove 40 on the internal wall surface of the container 35. The pin 41 is then inserted into the groove so as to register with the notches 42 and fix the maze assembly 12 against rotation with respect to the container.

The maze configuration is generated internally by a series of circumferential slots 44 in the disks 20 and wherein slots 44 of adjacent, contacting disks 20 communicate with one another throughout the length of the maze so as to define a continuous but winding passageway in communication with the bore 15 along the full length of the maze. The slots 44 are further characterized as illustrated in FIGS. 3 to 7 by varying in width and circumferential orientation at predetermined intervals along the length of the maze and further are of a radial length or extent to receive the radially extending dog 16 on the shaft 14. It should be noted also that one or more disks in succession may have extra or auxiliary slots 44', such as, the disks illustrated in FIGS. 4, 5 and 6 so as to define blind or blocked passageways, for a purpose to be described, at intervals along the length of the maze.

In assembling the disks 20 together, alignment bores or markers M are provided for insertion of a rod or wire to line up the disks prior to fastening together so that the disks are circumferentially oriented to assure that slots properly communicate with one another throughout the entire length of the maze.

In use, the shaft 14 is inserted through the maze 12 by alignment of the dog 16 with the slot 39 and advancing axially into the aligned slot of the next adjacent disk 20. By a combination of axial and rotational movement, the shaft can be advanced through the winding passageways by a succession of rotational and axial movements. As further noted earlier, selected series of disks may have blind or blocked passageways so as to create a false impression of advancing the shaft through the continuous passage defining the maze. It is then necessary to retract the shaft and locate the proper path or guideway for continued advancement until the shaft reaches the home or end position with the dog 16 reposed in the slot 32 in the end disk 30. In order to remove the shaft from the maze, the process is reversed by withdrawing the dog through the winding passageway formed through the interconnected slots 44 of the disk. It will be apparent that, if desired, the central opening 15 may continue through end 36 of the container and that the handle or knob 18 may be removable from the shaft so that the shaft may be inserted into the home position as described without necessity of advancing forwardly through the maze. In that event, the player is required only to retract or withdraw the shaft by advancing the dog through the maze in the manner described. The maze device of the present invention may be formed of any suitable material, preferably metal or plastic. The device either may be opaque, translucent or transparent.

DETAILED DESCRIPTION OF MODIFIED FORM OF INVENTION

A modified form of maze 10 is illustrated in FIGS. 8 to 13 wherein like or similar parts to those of the form cf invention of FIGS. 1 to 7 are correspondingly enumerated with prime numbers. In the modified form, a maze 10' is once again broadly comprised of a plurality of disk-like elements 20' assembled together with bolts 26' which extend through aligned bores or openings 28', and a shaft 14' is provided with a radially extending arm or dog 16' at its leading end and a handle or knob 18' at its rearward, exposed end. The disk elements 20' are provided with external notches 42' which must be aligned with ribs 40' on the inner wall of a container or canister 35'. In this case, the canister is provided with an externally threaded open end 50, and an end cap 52 is provided with complementary internal threading 54 for threaded engagement with the threaded end 50 of the container. The cap 52 is threaded onto the end of the container such that slotted portion 55 is properly aligned with the endmost slot on the disk elements 20' so as to serve as an entrance for advancement of the arm 16' into the maze. Although not shown in detail, the disk elements 20' are assembled together with a disk 30' corresponding to the disk 30 at the leading or home end of the maze so that the shaft 14' and its arm 16' will normally be positioned in the fully inserted or home position with the arm 16' within the circumferential slot 32 of the disk 30 and fixed by the ball plunger 34.

Figures 8, 9, 10, 11, 12, 13:
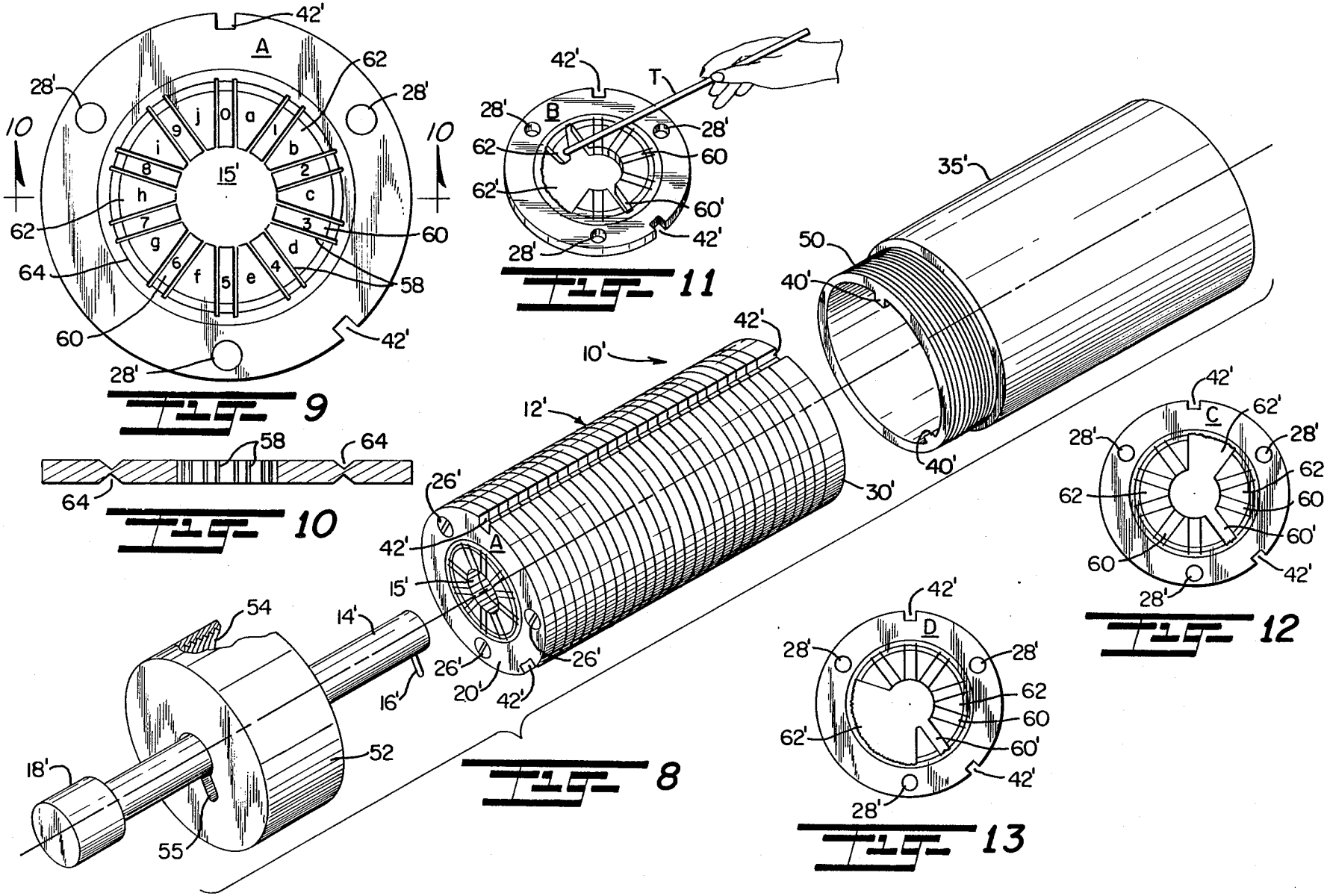
FIG. 8 is another exploded view of a modified form of maze in accordance with the present invention.
FIG. 9 is a front view in elevation of one of the disk elements of the form of invention illustrated in FIG. 8.
FIG. 10 is a cross-sectional view taken about lines 10—10 of FIG. 9.
FIG. 11 is a somewhat perspective view illustrating the method of forming selected slots in one of the disk elements, such as, that illustrated in FIG. 9.
FIGS. 12 and 13 are front views in elevation illustrating different slot configurations in the disk elements employed in the modified form of invention illustrated in FIG. 8.

A particular feature of the modified form is that different maze designs or patterns can be formed by the individual player or user. To this end, each disk is composed of a somewhat frangible material and is correspondingly provided with closely spaced pairs of narrow, radially extending slits or grooves 58 at spaced circumferential intervals around a common opening or center bore 15' to define radial spokes 60 between each closely spaced pair of slits 58 and define wedge or pie-shaped sectors 62 between adjacent angular pairs of slits 58. The slits 58 are of a length just greater than that of the arm 16' but of a width less than the arm 16' so that it is not possible for the arm 16' to enter any of the slits 58, and a circumferential groove 64 intersects the outer peripheral ends of the slits 58. The groove 64 may be suitably formed by scoring from opposite faces of the disk partially through the thickness, as illustrated in FIG. 10. As further illustrated in FIGS. 11, 12 and 13, individual spokes 60 and wedges 62 may be selectively removed by bending the sectors 60 and 62 about the score line or groove 64 with a suitable tool T so as to fracture or separate the sector 60 or 62 from the disk and leave a radial slot 60' or a generally circumferential slot 62', as shown in FIGS. 11 and 12. As represented both in FIGS. 11 through 13, one or more of the slots 60 and 62 may be formed according to the maze configuration or pattern desired. Especially when intended for use by the novice, appropriate worksheets can be provided to instruct the user on a proper sequence of sectors 60 and 62 to be removed from a series of disks 20' in forming a maze 12'. Thus, as illustrated in FIG. 9, the disk elements may be appropriately coded in alphabetical order, such as, the letters "A", "B", "C", etc., and the sectors on each disk, starting at the 12 o'clock position, may be appropriately coded or numbered, such as, with numbers starting with "0" and proceeding through "9" for radial slots, and lower case letters starting with "a" and proceeding through to "j" for the wedges 62. A table or set of illustrations on the worksheet or instructions would then again indicate which spoke(s) 60 and wedge(2) 62 to remove from each disk in succession and it is therefore important that the disks be assembled together in that same sequence in order for the sectors to be properly aligned. Further, as described with reference to FIGS. 1 to 7, it is possible to create blind passages by removal of spaced spokes 60 or sectors 62 from each disk.

Typical instructions provided in a worksheet would be provided as follows:

1. Remove spoke 7 from disk A through G.
2. Remove spoke 6 and wedge g between spokes 6 and 7 from disk G.
3. Remove spoke 6 from disks H and I.
4. Remove spoke 5 and wedge f between spokes 5 and 6 from disk I; and remove spoke 5 from disks I back through disk E (for reverse movement).
5. In disk E, remove spokes and wedges between spokes 5 and 3.

Generally, the pattern established will require varying degrees of axial movement in both directions together with rotational movement so that the player must sense or feel possible changes in direction through a full range of movements. Moreover, it will be evident that mazes of increasing complexity can be provided and the player can gradually work up through a series of increasingly complex mazes by periodically removing different combinations of the sectors as described. A particular advantage of providing preformed disks of corresponding construction is of course elimination of fabricating different intricate patterns but permit mass production of a single disk accompanied with the necessary instructions for forming different maze patterns out of a series of corresponding disks.

DESCRIPTION OF PREFERRED FORM OF LOCKING DEVICE

Figure 14:
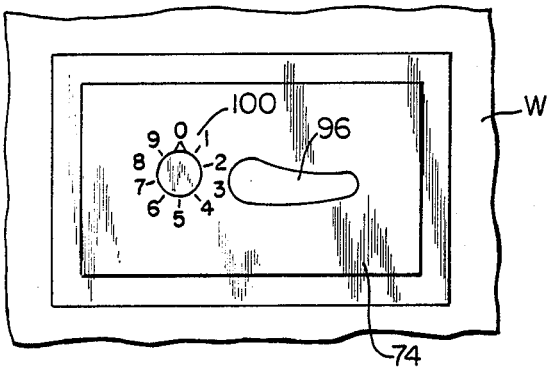
FIG. 14 is a front view in elevation of a locking device incorporating the principles of the present invention.
Figure 15:
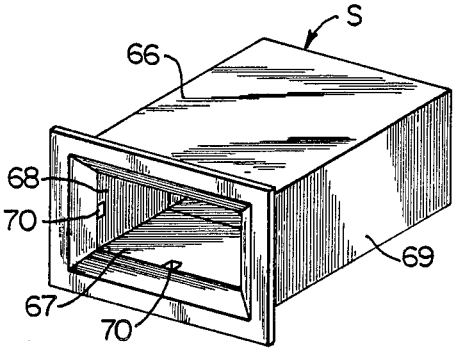
FIG. 15 is a perspective view of a conventional cabinet to be locked, such as, for a wall cabinet or safe.
Figure 17:
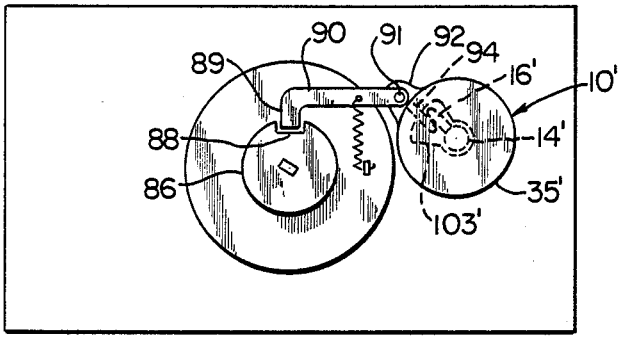
FIG. 17 is a rear view of the panel illustrated in FIG. 16.
Figure 16:
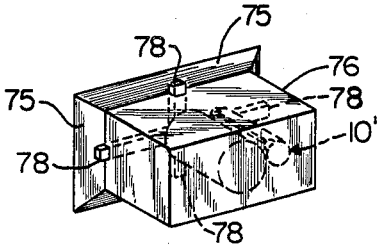
FIG. 16 is another perspective view illustrating a locking panel employed as a part of the wall safe of FIGS. 14 and 15.
Figure 18:
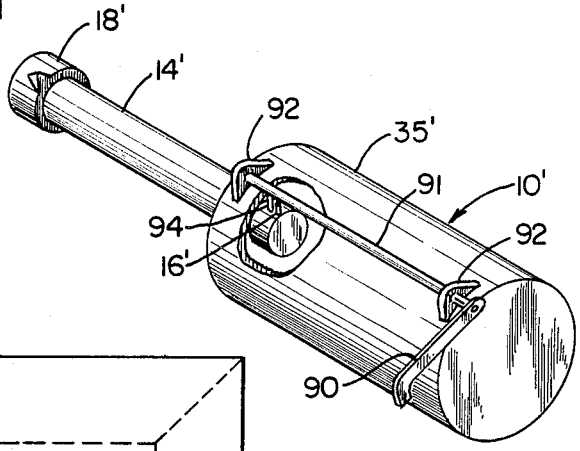
FIG. 18 is a somewhat rear perspective view of the maze-type locking device employed in the form of invention illustrated in FIGS. 14 to 17.

Referring to FIGS. 14 to 19, there is illustrated a locking device employing either one of the maze constructions described in FIGS. 1 to 7 and 8 to 13. For purposes of illustration, that described in FIGS. 14 to 18 will be used to identify elements of the maze assembly 10' as a combination lock. As a setting for this form of invention, FIGS. 14 and 15 illustrate a wall cabinet or safe S having top and bottom walls 66, 67 and opposed sidewalls 68, 69 set into a cavity or space formed in a wall W. The walls 66–69 are flared outwardly at the entrance to the safe and are provided with latch-receiving depressions 70. A front panel 74 as shown in FIGS. 14 and 16 has a rear housing 76 for the combination lock 10', the front panel 74 having outwardly flaring edges 75 which are complementary to the outwardly flared entrance of the walls 66 to 69.

Figure 19:
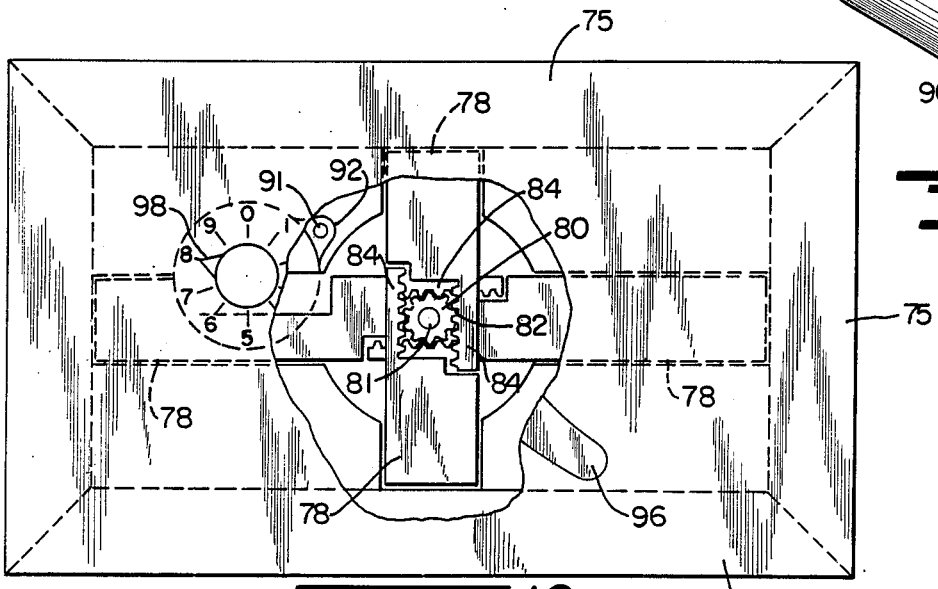
FIG. 19 is another view illustrating a typical form of locking mechanism employed in combination with the locking device of FIGS. 14 to 18.
Figure 20:
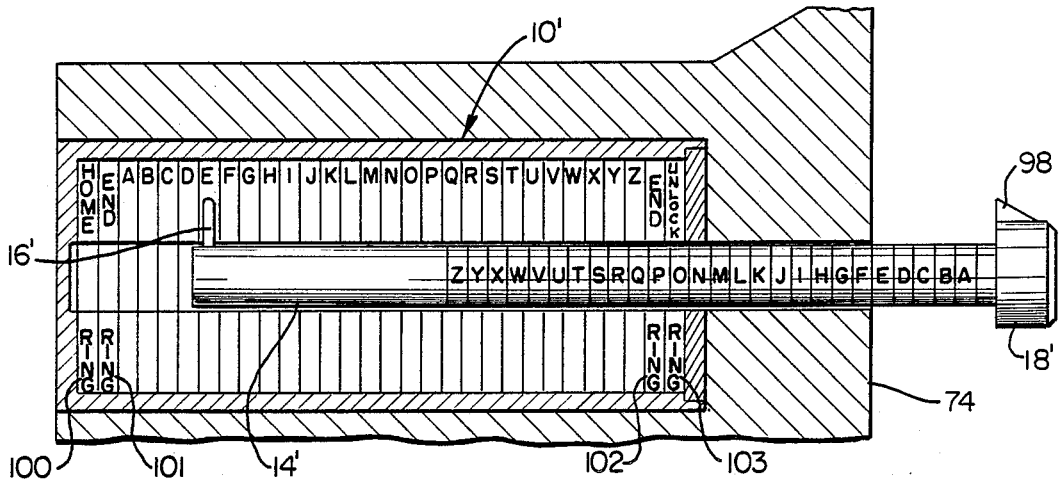
FIG. 20 is a view partially in section of the locking device illustrated in FIG. 18.

Latching elements 78 are arranged in mutually perpendicular relation to one another at the front of the rear housing directly behind the outer edges 75 so as to be properly aligned with the depressions 70 when the front panel 74 is placed in position within the safe, as illustrated in FIG. 14. As shown in FIG. 19, a pinion 80 is keyed to shaft 81 with external gear teeth 82 on the pinion in intermeshing engagement with toothed extension arms 84 of each of the latch bars 78, the extension arms 84 being similarly arranged in mutually perpendicular relation to one another to intermeshingly engage separate quadrants of the pinion 80. Thus, rotation of the pinion 80 in a manner to be described will impart longitudinal movement to the latching elements 78 and, depending on the direction of rotation of the pinion will cause synchronized expansion or contraction of the latching elements into and away from seated engagement with the openings 70 in the wall safe. A cylindrical member 86 extends rearwardly from the shaft through the housing 76 and has a notched portion 88 at its rearward end which receives the free end 89 of a spring-loaded lever arm 90. Arm 90 is pivoted at its opposite end about a pivot shaft 91 which is mounted by appropriate brackets 92 on the external surface of the container 35' of the combination lock. A link arm 94 angles downwardly from the opposite end of the shaft 91 through an opening in the front end of the container 35' which communicates with a slot 103' disk or of endmost ring 103, as shown in FIG. 20, so as to project into the path of dog 16' on shaft 14' of the maze unit 10' As viewed in FIG. 17, the link arm 94 is fixed to the lever arm 90 so that when caused to rotate in a clockwise direction about the pivot 91, arm 90 is lifted away from normally locked engagement with the notched end 88 of the cylinder 86 to permit rotation of the pinion by means of the handle or lever arm 96 which is fixed to the end of the shaft 81.

The locking unit 10' is mounted in spaced parallel relation to the shaft 81, and the knob or handle 18' at the exposed end of the shaft 14' includes a pointer 98 which is aligned with the dog 16' on the shaft. Thus, when the pointer 98 is rotated across the face of dial 100 on the front panel 74 into alignment with one of the numbers "1" through "0" the dog 16' will follow that rotation. As shown in FIG. 20, the shaft 14' is provided with appropriate designations, such as the letters "A" through "Z" in alphabetical order along the length of the shaft 14' to cooperate with the numbers "1" through "0" on the face of the dial in working a particular combination to unlock the panel 74. The disks 20 are lettered in reverse order so that the dog 16' will be lined up with a disk that corresponds to that designation on the shaft 14' just outside of the panel 74, as shown in FIG. 20. For the purpose of illustration, a typical lock combination may be as follows:

EASY 10248

Instructions for the full combination would then appear as follows:

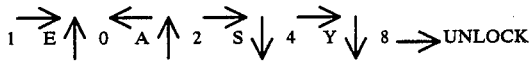

Assuming that the shaft is fully inserted into the lock with the dog 16' located within home ring 100, the pointer 98 is rotated to number "1" and advanced axially to the position "E", as illustrated in FIG. 20. Next, the pointer is rotated counterclockwise to the number "0" and advanced in an axial direction back to the disk "A". Pointer 98 is then rotated counterclockwise again to the number "2" and axially withdrawn to the letter or position "S" where it is rotated in a clockwise direction to the number "4" and once again retracted or withdrawn in an axial direction to the position "Y"; and the pointer 98 once again rotated in a clockwise direction to number "8" and retracted past the end ring 102 into alignment with the unlock ring or disk 103. In that position the dog is rotated to cause pivoting of the lever arm 94 and unlatching of the element 90 away from the notched disk 86 whereupon the handle 96 is rotated to retract the latching bars 78 out of engagement with the opening 70 so that the panel 74 can be removed from the cabinet.

Preferably, in its use as a locking device, the maze 10' is totally concealed within the panel 74 and, when the shaft 14' is drawn outwardly to align the dog 16' with the unlocking ring 103, the shaft will remain intact with the cylinder and is not free to be removed through the front wall thickness of the panel. In order to return the panel into its locked position with respect to the safe, the dog 16' is once again rotated to pivot the level arm 90 away from its normally locking position with the notched portion 88 of the cylinder 86 until the blocking elements 78 are aligned with the openings 70. At that point, the lever arm 96 is rotated to return the locking elements into normally locked disposition within the opening 70 and realign the notched portion 88 with the end of the lever arm 90 so that the end 89 is free to move back into engagement with the notched portion 88. The shaft 14' is then reversed to follow the return path of the maze back to is original position.

Figure 21:
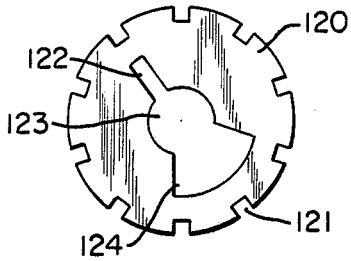
FIGS. 21, 22 and 23 illustrate disk elements employed in elevational views in the locking device of FIG. 20.
Figure 22:
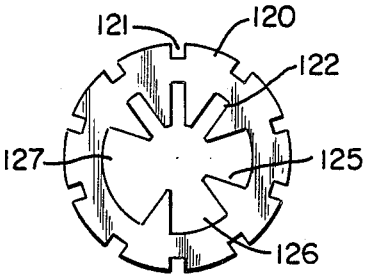
Figure 23:
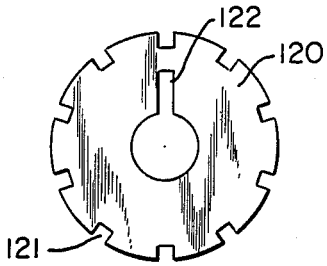

FIGS. 21 to 23 illustrate modified forms of disks 120 which may be employed in place of either of the disks 20 and 20' as described in previous forms. The disks 120 are provided with a plurality of circumferentially spaced notches 121 around their periphery and a combination of narrow, radially extending slots 122 from a central opening or bore 123 and wider circumferential slots 124. As in the previous forms, the slots may vary in width, for example, as designated at 125, 126 and 127 in FIG. 22, coupled with radial slots 122; or, as shown in FIG. 23, a single radial slot 122. Construction of the disks 120 in this fashion affords a more universal type of disk construction which can be employed at multiple or different positions and by appropriate coding to correlate the location of the slots 122 to 127 with selected ones of the notches 121.

Figure 24:
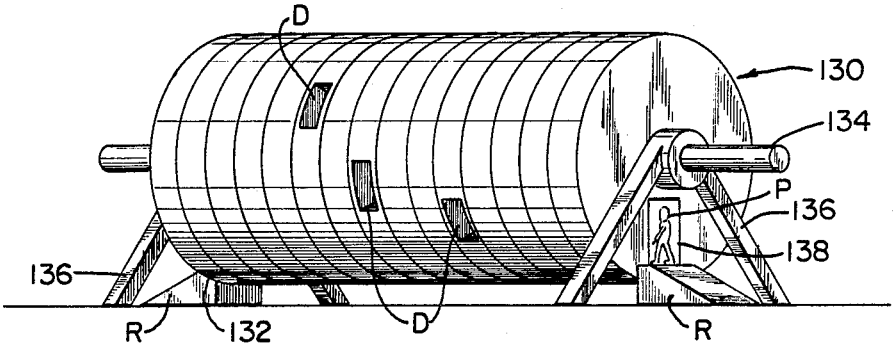
FIG. 24 is a perspective view of another modified form of maze constructed in accordance with the present invention as a walk-through size model.

Another modified form of invention is illustrated in FIG. 24 wherein a maze 130 is devised for an amusement park, the maze comprising a series of disks 132 constructed in the same manner as disks 20 and 20' but greatly enlarged so as to be adaptable for use in amusement parks. Specifically, the disks 132 are journaled on a common shaft 134 having end supports 136 to position the entire maze in an elevated position above the ground or floor surface. A suitable ramp R is provided to permit a person P to advance into the front end of the maze and through an end slot 138. A series of radially extending slots 138 are provided in communication with one another to define a continuous passageway throughout the length of the maze 130 in a manner corresponding to that described with respect to FIGS. 1 to 7 and 8 to 13. In this case, however, the slots 138 need not communicate with the center shaft 134 but may be formed out of the wall thickness as shown with respect to the slot 138. The player must advance through the maze by traversing the interconnected series of slots and, in so doing, will impart rotation to the maze about the shaft 134 so as to maintain an essentially upright position. Depending upon the degree of complexity, suitable access doors D, as represented in FIG. 24, may be provided so that the player may exit, if desired, prior to completing the maze or labyrinth.

DETAILED DESCRIPTION OF MODIFIED FORM

Figure 25:
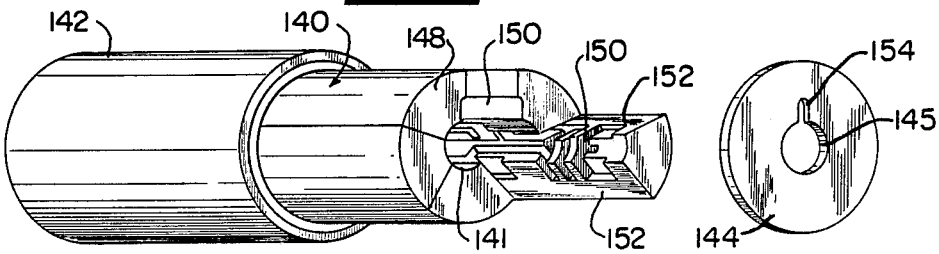
FIG. 25 illustrates another form of maze similar to that illustrated in FIGS. 1 to 7 but wherein the maze is formed in a plurality of sections of a common cylinder in communication with one another.

A modified form of maze construction is illustrated in FIG. 25 wherein a generally cylindrical maze 140 is once again inserted into a container 142, and a circular end plate 144 includes openings 145 aligned with central opening 141 of the maze 140. The container 142 may essentially correspond in construction to the container 35 of the preferred form of FIGS. 1 to 7 and, although not shown, may suitably be provided with a locating pin similar to the pin 41 of the preferred form to mate with a notch, not shown, on the external surface of the maze 140 so as to prevent shifting or rotation of the maze 140 relative to container 142.

A particular feature of the modified form of maze resides in the molded construction of a plurality of generally pie-shaped or wedge-shaped sections 148 which extend the full length of the maze 140 and are assembled together as illustrated to form the complete cylinder with central opening 141. Again, the maze configuration is internally generated to form a series of circumferential slots 150 in each of the sections or sectors and wherein aligned slots of adjacent sectors are in communication with one another throughout the length of the maze 140 to define a continuous but winding passageway in communication with the central bore 141 throughout the length of the maze 140. The slots 150 will vary in width and circumferential orientation according to a particular maze configuration as selected or generated, and the slots are of a radial length to receive a radially extending dog or arm on the shaft which, although not shown, would correspond to the shaft 14 of the preferred form of FIGS. 1 to 7.

Each sector 148 must be individually molded according to the selected maze design so that the slots formed in each adjoining sector will be complementary to one another when the radial wall surfaces 152 of adjoining sectors are assembled together in abutting relation to one another. Thus the completed maze is capable of forming the same resultant labyrinth or passageway as those illustrated and described with respect to the forms of invention illustrated in FIGS. 1 to 20. If desired, the sectors 148 may be bonded or otherwise interlocked together so as to maintain the proper, precise alignment between the slots and adjoining sectors.

In use, the end plate 144 is provided with a radially extending slot 154 which is aligned with one of the slots 150 at the entrance end of the maze 140 so as to permit insertion of the dog on the shaft into the maze. As before, by a combination of axial and rotational movement, the shaft can be advanced through the labyrinth until it reaches the opposite end or home position of the maze 140, and the shaft can be removed by retracing the movement of the dog back through the winding passageway until it is released from the slot 154. Again, the labyrinth formed is susceptible of unlimited variations in the formation of continuous, interrupted or blocked passageways and similarly can be two directional in that the dog can be forced to undergo movement in opposite axial directions in advancing through the correct combination of passageways defining the maze before reaching the home position.

It is therefore to be understood that the above and other modifications and changes may be made in the construction and arrangements of elements comprising preferred and alternate forms of the present invention without departing from the spirit and scope thereof as defined by the appended claims and reasonable equivalents thereof.

I claim:

1. A labyrinth device comprising:

an elongated maze member provided with a longitudinally extending bore of a limited diameter with respect to the size of said maze member and extending through one end of said mze member, said elongated maze member comprising a plurality of elongated generally wedge-shaped solid sections, each said section having elongated circumferential slots formed therein, said slots of adjacent said sections being in communication with one another and with said bore to define said passageway;

a shaft disposed in said bore including a radially extending arm rigidly attached to said shaft, said shaft being freely rotatable and axially movable in said bore and having a trailing end projecting from said member to be engaged for combined rotatable and axially slidable movement of said shaft and arm with respect to said bore; and said maze member including a continuous but winding internal passageway defining an internal maze extending radially and outwardly from communication with said bore along the length thereof, said maze member being solid except for said bore and said passageway, said passageway varying in rotational orientation at predetermined intervals along the length of said bore and further being of a radial length to receive said transversely extending arm so that said arm can advance through said passageway by combined rotational and axial movement, said passageway comprising a plurality of circumferential slots being oriented to define a plurality of separate winding passageways constituting said internal maze, and means blocking selected of said passageways thereby to require multidirectional movement of said arm in a direction parallel to the axis of said bore in order to advance through the length of said maze member.

2. A labyrinth device according to claim 1, said elongated member being generally cylindrical and there being a single exist slot extending radially from said bore at the end of said elongated member.

3. A labyrinth device according to claim 2, including an outer cylindrical housing, said cylindrical member disposed in said housing, and means fixing said cylindrical member against rotation with respect to said housing.

4. A labyrinth device according to claim 2, said passageway comprising a plurality of circumferential slots being oriented to define a plurality of separate winding passageways constituting said internal maze, and means blocking selected of said passageways thereby to require multidirectional movement of said arm in a direction parallel to the axis of said bore in order to advance through the length of said maze member.

5. A labyrinth device according to claim 2, said elongated member comprising a plurality of adjoining annular disks aligned bout a common axis, each said disk provided with a central bore and a circumferential slot therein, said slots of adjacent said disks being in communication with one another to form said passageway.

6. A labyrinth device according to claim 5, at least selected of said disks having a plurality of said slots, selected of said slots of adjacent of said disks being in communication with one another to define said passageway along the length of said cylindrical member.

7. A labyrinth device according to claim 1, said elongated maze member comprising a plurality of elongated generally wedge-shaped solid section, each said section having elongated circumferential slots formed therein said slots of adjacent said sections being in communication with one another and with said bore to define said passageway.

8. A labyrinth device according to claim 1, there being a first series of circumferentially arranged coded positioning markers on an external face of said elongated maze member and a second series of coded positioning markers axially spaced along an external surface of said trailing end of said shaft, said trailing end projecting from said elongated maze member to be manually grasped for combined rotatable and axially slidable movement in accordance with a known combination of axial and rotational movements necessary to advance said arm through said passageway.

9. A labyrinth device comprising:

an elongated, generally cylindrical maze ember provided with a longitudinally extending bore of a limited diameter with respect to the diameter of said maze member and extending through at least one end of said member, said cylindrical member consisting of a plurality of disks, each said disk provided with a circumferential slot therein, the slots of adjacent disks being in communication with one another and fastening means interconnecting said disks in fixed face-to-face relation to one another;

a shaft disposed in said bore including a radially extending, elongate arm rigidly connected to its leading end, said shaft being freely rotatable and axially movable in said bore and having a trailing end projecting from the one end of said member to be manually grasped for combined rotatable and axially slidable movement with respect to said bore; and said mze member provided with a plurality of circumferential, radially elongated slots defining an internal maze-like passage extending radially and outwardly from communication with said bore, said slots varying in width and circumferential orientation at predetermined intervals along the length of said bore and further being of a radial dimension to receive said radially extending arm whereby said shaft can be advanced through said bore by combined rotational and axial movement of said arm through the passage defined by said slots, said slots being oriented to define a plurality of passages constituting a mze, and means blocking selected of said passages thereby to require multidirectional movement of said arm in a direction parallel to the axis of said bore.

10. A labyrinth device according to claim 9, there being a single entrance slot at the one end of said member through which said bore extends.

11. A labyrinth device according to claim 9, at least selected of said disks having a plurality of slots, selected ones of said slots of adjacent disks being in communication with one another to define a continuous passage in the form of a maze traversing the substantial length of said member.

12. A labyrinth device according to claim 9, each said disk having a circumferentially scored portion therein, radial slits extending between said bore and said scored portion at spaced circumferential intervals around each disk to define generally pie-shaped portions which are selectively and manually removable to define said circumferential slots.

13. A labyrinth device according to claim 12, said radially extending slits including at least one pair of slits in closely spaced relation to one another so that removal of said scored portion between said closely spaced slits leaves a relatively narrow circumferential slot in said disk.

14. A labyrinth device according to claim 9, there being a first series of circumferentially spaced coded positioning markers on an external face of said elongated maze member and a second series of axially spaced coded positioning markers along an external surface of said trailing end of said shaft, said trailing end projecting from said elongated maze member to be manually grasped for combined rotatable and axially slidable movement in accordance with a known combination of axial and rotational movements necessary to advance said arm through said passageway.

15. A labyrinth device comprising:

an elongated member provided with a longitudinally extending bore extending radially through one end of said member;

a shaft disposed in said bore including a transversely extending arm, said shaft being freely rotatable and axially movable in said bore and having a trailing end projecting from said member to be engaged for combined rotatable and axially slidable movement of said shaft and arm with respect to said bore; and said members including a continuous ut winding internal passageway defining an internal maze extending radially and outwardly from communication with said bore along the length thereof, said member being solid except for said bore and said passageway, said passageway varying in rotational orientation at predetermined intervals along the length of said bore and further being of a radial length to receive said transversely extending arm so that said arm can advance through said passageway by combined rotational and axial movement, said elongated member comprising a plurality of adjoining annular disks aligned about a common axis, each said disk provided with a central bore and a circumferential slot therein, said slots of adjacent said disks being in communication with one another to form said passageway, each said disk being circular and having a circumferentially extending scored portion therein, and radial slits extending between said bore and said scored portion at spaced circumferential intervals to define generally pie-shaped sectors in said disk which are selectively removable according to a predetermined code to form said circumferential slots.

16. A labyrinth device according to claim 15, said elongated member comprising a plurality of thin, flat disks interconnected in face-to-face relation to one another, said core extending centrally through said disks, and at least one slot in each said disk defining said passageway in said member.

17. A labyrinth device according to claim 15, said radially extending slits including at least one pair of closely spaced slits whereby removable of said portion between said closely spaced slits forms a relatively narrow circumferential slot therein.

* * * * *